US006139185A

United States Patent [19]

*Hamilton et al.

[11] Patent Number: 6,139,185

[45] Date of Patent: Oct. 31, 2000

[54] FLEXIBLE BAG WITH SELECTIVELY-ACTIVATIBLE SUPPORT-ENGAGEMENT FEATURE

[75] Inventors: Peter Worthington Hamilton; Geneva Gail Otten, both of Cincinnati, Ohio

[73] Assignee: The Procter & Gamble Company, Cincinnati, Ohio

[ * ] Notice: This patent is subject to a terminal disclaimer.

[21] Appl. No.: 08/853,428

[22] Filed: May 9, 1997

[51] Int. Cl.[7] ..... B65D 33/14; B65D 33/20

[52] U.S. Cl. ..... 383/11; 383/33; 383/71; 220/495.11

[58] Field of Search ..... 383/33, 211, 71, 383/93, 95, 11; 229/80; 156/221; 220/495.11, 495.06

[56] References Cited

U.S. PATENT DOCUMENTS

| | | | |
|---|---|---|---|
| 584,555 | 6/1897 | Lorenz . | |
| 605,343 | 6/1898 | Ross . | |
| 1,181,506 | 5/1916 | Cunningham | 383/11 |
| 1,608,901 | 11/1926 | Miller . | |
| 1,886,406 | 11/1932 | Kniffin | 220/495.11 X |
| 2,161,474 | 6/1939 | Klein | 229/80 |
| 2,324,440 | 7/1943 | Tormohlen | 220/495.11 X |
| 2,409,621 | 10/1946 | Geimer et al. | 383/93 X |
| 3,143,278 | 8/1964 | Heibert | 383/93 |
| 3,148,799 | 9/1964 | Meroney . | |
| 3,346,883 | 10/1967 | Ersek | 383/93 X |
| 3,353,662 | 11/1967 | Pickin | 383/71 X |
| 3,462,067 | 8/1969 | Shore . | |
| 3,625,414 | 12/1971 | Caiola | 383/93 |

(List continued on next page.)

FOREIGN PATENT DOCUMENTS

| | | | |
|---|---|---|---|
| 0 683 105 | 11/1995 | European Pat. Off. . | |
| 1191546 | 10/1959 | France | 383/93 |
| 2676995 | 12/1992 | France | 383/11 |
| 296 03 372 | 6/1996 | Germany . | |
| 09226901 | 9/1997 | Japan . | |
| 2074984 | 11/1981 | United Kingdom | 383/11 |
| 95/11181 | 4/1995 | WIPO . | |
| WO 95 13225 | 5/1995 | WIPO . | |
| WO 95 28331 | 10/1995 | WIPO . | |
| WO 97 25268 | 7/1997 | WIPO . | |

*Primary Examiner*—Jes F. Pascua
*Attorney, Agent, or Firm*—W. Scott Andes; Larry L. Huston; Donald E. Hasse

[57] ABSTRACT

A flexible bag comprising at least one sheet of flexible sheet material assembled to form a semi-enclosed container having an interior surface, an exterior surface, an opening having a peripheral edge, and a support-engagement feature located on the exterior surface at least partially surrounding the peripheral edge. The support-engagement feature comprises a strip of material having a first side facing outwardly from the exterior surface and a second side facing inwardly toward the interior surface. The first side exhibits an adhesion peel force after activation by a user which is greater than an adhesion peel force exhibited prior to activation by a user. The support-engagement feature preferably at least partially, and more preferably fully, circumferentially surrounds the peripheral edge. The selectively-activatible support-engagement feature also preferably functions as a closure means to secure the opening of the flexible bag in a substantially closed condition when the bag material is gathered about the opening, thus providing for ease of sealability without the need for additional closure features or separate elements. Additional closure means may be provided utilizing the selectively-activatible materials suitable for use as a support-engagement feature located on the inner surface of the peripheral edge of the bag. The support-engagement features of the present invention provide a flexible bag which is capable of reliably engaging a supporting device so it may be supported in an open condition for filling purposes. Such a feature also reduces the likelihood of trapped air and/or free space occurring when the bag is utilized with a rigid or semi-rigid durable container.

19 Claims, 3 Drawing Sheets

U.S. PATENT DOCUMENTS

| | | | |
|---|---|---|---|
| 3,682,372 | 8/1972 | Rodley . | |
| 3,738,565 | 6/1973 | Ackley et al. . | |
| 3,970,241 | 7/1976 | Hanson . | |
| 4,079,767 | 3/1978 | Howard | 383/95 X |
| 4,335,769 | 6/1982 | McManus | 383/11 |
| 4,410,130 | 10/1983 | Herrington . | |
| 4,468,811 | 8/1984 | Shaw et al. | 383/211 X |
| 4,519,095 | 5/1985 | Clayton . | |
| 4,571,337 | 2/1986 | Cage et al. . | |
| 4,620,319 | 10/1986 | Sheehan et al. | 383/33 |
| 4,736,450 | 4/1988 | Van Erden et al. . | |
| 4,808,421 | 2/1989 | Mendenhall et al. . | |
| 4,842,421 | 6/1989 | Bullard et al. | 383/95 X |
| 4,848,930 | 7/1989 | Williams et al. . | |
| 4,898,477 | 2/1990 | Cox et al. . | |
| 4,906,108 | 3/1990 | Herrington et al. | 383/71 |
| 4,913,560 | 4/1990 | Herrington | 383/71 |
| 4,930,644 | 6/1990 | Robbins, III . | |
| 4,973,171 | 11/1990 | Bullard | 383/95 X |
| 4,978,231 | 12/1990 | Ling et al. | 220/495.11 X |
| 5,044,774 | 9/1991 | Bullard et al. . | |
| 5,061,500 | 10/1991 | Mendenhall . | |
| 5,195,829 | 3/1993 | Watkins et al. . | |
| 5,314,252 | 5/1994 | Happ . | |
| 5,364,189 | 11/1994 | Kuge et al. . | |
| 5,507,579 | 4/1996 | Sorenson . | |
| 5,524,990 | 6/1996 | Buck . | |
| 5,547,284 | 8/1996 | Imer . | |
| 5,575,747 | 11/1996 | Dais et al. . | |
| 5,605,594 | 2/1997 | May . | |
| 5,609,419 | 3/1997 | Byers, Jr. | 383/33 |
| 5,662,758 | 9/1997 | Hamilton et al. | 156/221 |

FLEXIBLE BAG WITH SELECTIVELY-ACTIVATIBLE SUPPORT-ENGAGEMENT FEATURE

FIELD OF THE INVENTION

The present invention relates to flexible bags, particularly those suitable for use in conjunction with supporting devices for maintaining the bag in an open condition for receiving articles of various origins. The present invention further relates to such flexible bags suitable for use as a removable, replaceable liner in a reusable durable container.

BACKGROUND OF THE INVENTION

Flexible bags for use in the containment of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal, drawstrings, ears, or flaps, or separately provided such as a plastic or paper-clad-wire tie, completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible bags of the foregoing variety are typically formed from polymeric film, such as polyethylene or other members of the polyolefin family, in thicknesses of between about 0.0002 inches to about 0.002 inches. Such films are frequently opaque and/or colored, but may also be transparent.

Conventional flexible bags create an inherent challenge in terms of being able to hold the flaccid bag in an open condition with at most one hand so that the other hand can manipulate another container to pour the contents into the bag or peel, cut, or trim items for insertion into the bag. Accordingly, it is common practice to use such flexible bags as a reusable, replaceable liner in a supporting device such as a hoop or rigid or semi-rigid container having an opening approximately corresponding to the size of the mouth of the bag. In order to avoid having the bag fall inside the supporting device and render the mouth of the bag closed or inaccessible, it is also common practice to draw the mouth of the bag laterally outwardly of the opening in the supporting device and downwardly for at least a small extent over the flange, lip, or upper edge of the supporting device to frictionally engage the supporting device. Such measures as tying knots in the mouth of the bag to reduce its circumference and retaining devices such as elastic bands are also sometimes utilized. One common scenario for illustrative purposes is the use of plastic trash bags as liners in reusable, durable trash containers.

While this approach has become commonplace, difficulties remain in that it is sometimes difficult to match the size of the bag with the size of the supporting device. Also, when frictional engagement is less than required the action of placing items within the flexible bag has a tendency to cause the mouth of the bag to creep upwardly toward the flange, lip, or upper edge of the supporting device to the point where the mouth of the bag may slip free from the rim of the supporting device.

Another issue with this approach is that air and/or free space may be trapped between the exterior surface of the flexible bag and the interior surface of the supporting device when the initially empty flexible bag is inserted into a larger, typically largely-enclosed rigid or semi-rigid durable container and frictionally or tightly engaged with the rim of the container by folding or stretching the bag material. Such a situation frequently limits the ability to fully utilize the full volume potential of the flexible bag as the trapped air prevents the bag from expanding to approach the interior volume of the durable container.

While flexible bags of the foregoing variety have enjoyed a fair degree of commercial success, their reliance upon mechanical closures tends to cause difficulty in operation for individuals having impaired manual dexterity such as children, the elderly, arthritis patients, etc. Moreover, such mechanical closures typically require alignment of mechanical elements for operation which can prove challenging for those with impaired vision or impaired hand-eye coordination. Many mechanical closure mechanisms also provide leakage sites at such locations as the end of interlocking channels where liquid or gases can leak into or out of the bag. Other closure designs often require the user to engage in tying or twisting motions.

In an attempt to address this issue alternative closure mechanisms have been developed which rely upon strips or regions of adhesive to bond superimposed regions of the bag. While these closures address some of the difficulties in utilizing separate closure elements or interlocking mechanical elements, some adhesive closure mechanisms require removable liners to protect the adhesive from premature activation, thus adding additional elements for assembly and an additional activation step before use. Moreover, some protected adhesive configurations require interlocking grooves, channels, or protrusions which must be properly registered to engage the adhesive, thus again raising the visual and coordination requirements of conventional mechanical closure mechanisms.

Accordingly, it would be desirable to provide a flexible bag which is capable of reliably engaging a supporting device so it may be supported in an open condition for filling purposes.

It would also be desirable to provide such a flexible bag which reduces the likelihood of trapped air and/or free space occurring when the bag is utilized with a rigid or semi-rigid durable container.

It would further be desirable to provide a flexible bag having improved sealability in use.

It would still further be desirable to provide such a bag which provides the foregoing attributes in a convenient unitary form, obviating the need for separate closure devices.

SUMMARY OF THE INVENTION

The present invention provides a flexible bag comprising at least one sheet of flexible sheet material assembled to form a semi-enclosed container having an interior surface, an exterior surface, an opening having a peripheral edge, and a support-engagement feature located on the exterior surface at least partially surrounding the peripheral edge. The support-engagement feature comprises a strip of material having a first side facing outwardly from the exterior surface and a second side facing inwardly toward the interior surface. The first side exhibits an adhesion peel force after activation by a user which is greater than an adhesion peel force exhibited prior to activation by a user.

The support-engagement feature preferably at least partially, and more preferably fully, circumferentially surrounds the peripheral edge. The selectively-activatible support-engagement feature also preferably functions as a closure means to secure the opening of the flexible bag in a substantially closed condition when the bag material is gathered about the opening, thus providing for ease of sealability without the need for additional closure features or separate elements. Additional closure means may be provided utilizing the selectively-activatible materials suitable for use as a support-engagement feature located on the inner surface of the peripheral edge of the bag.

The support-engagement features of the present invention provide a flexible bag which is capable of reliably engaging a supporting device so it may be supported in an open condition for filling purposes. Such a feature also reduces the likelihood of trapped air and/or free space occurring when the bag is utilized with a rigid or semi-rigid durable container.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
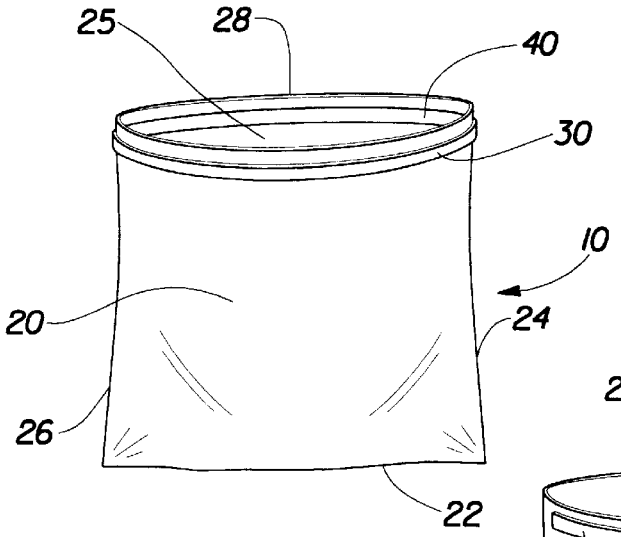
FIG. 1 is a perspective view of a preferred embodiment of a flexible bag in accordance with the present invention in an open, empty condition.

FIG. 1 depicts a presently preferred embodiment of a flexible bag 10 according to the present invention. In the embodiment depicted in FIG. 1, the flexible bag 10 includes a bag body 20 formed from a piece of flexible sheet material folded upon itself along fold line 22 and bonded to itself along side seams 24 and 26 to form a semi-enclosed container having an opening along edge 28. Flexible bag 10 also includes support-engagement feature 30 located adjacent to edge 28 for engaging a supporting device for holding the flexible bag in an open condition for filling in use. The support-engagement feature is selectively activatible, adherable to complementary surfaces, and releasable from such surfaces, as will be described hereinafter. As shown in FIG. 1, flexible bag 10 also includes an optional additional closure means 40 for securing the bag in a closed condition after use.

Flexible bag 10 is suitable for containing and protecting a wide variety of materials and/or objects contained within the bag body. FIG. 1 depicts the flexible bag 10 in an open condition wherein edge 28 is opened to admit materials and/or objects into the interior of the bag body portion of the flexible bag 10. Although depicted without gussets or pleats, the features of the present invention are equally applicable to bags formed with such structural elements. Bags such as the flexible bag 10 of FIG. 1 can be also constructed from a continuous tube of sheet material, thereby eliminating side seams 24 and 26 and substituting a bottom seam for fold line 22.

Figure 2:
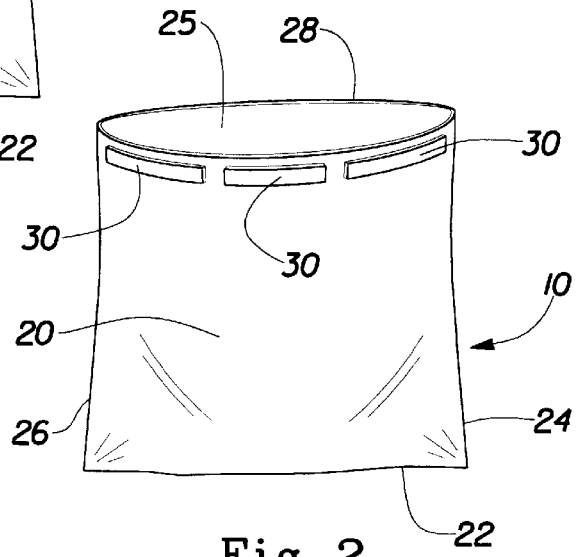
FIG. 2 is a perspective view similar to that of FIG. 1 of another embodiment of a flexible bag in accordance with the present invention.
Figure 3:
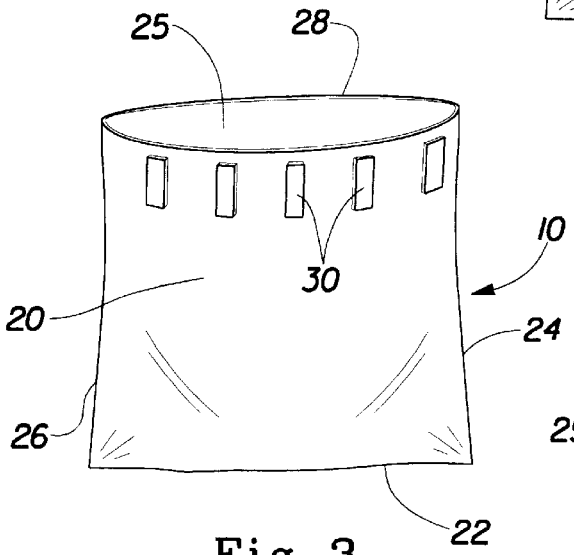
FIG. 3 is a perspective view similar to that of FIG. 1 of a further embodiment of a flexible bag in accordance with the present invention.
Figure 4:
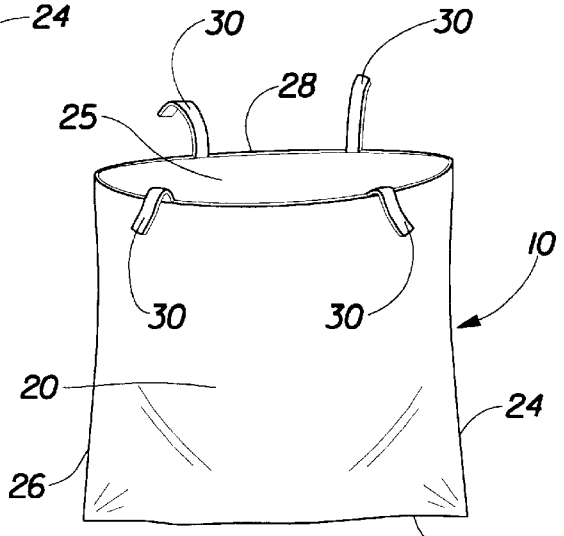
FIG. 4 is a perspective view similar to that of FIG. 1 of a further embodiment of a flexible bag in accordance with the present invention.
Figure 5:
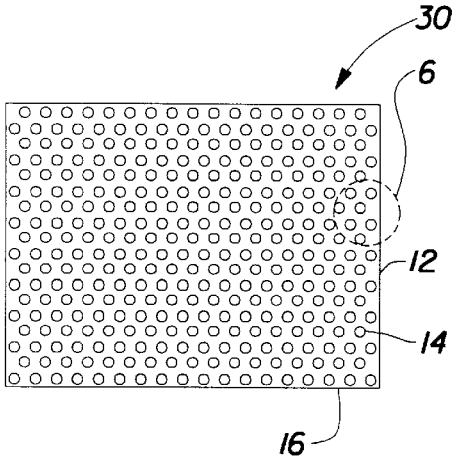
FIG. 5 is a top plan view of a preferred embodiment of a material suitable for use as a support-engagement feature of the present invention, disclosing a piece of material having truncated conical protrusions surrounded by an interconnected pattern of substance.
Figure 6:
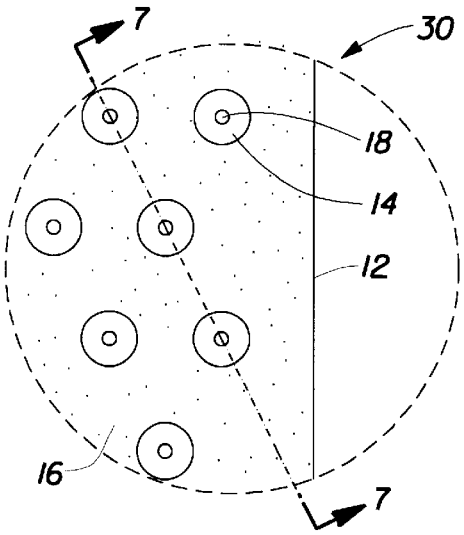
FIG. 6 is an enlarged partial top plan view of the material of FIG. 5, showing an array of protrusions.

In the preferred embodiment of FIG. 1, the support-engagement feature comprises a comparatively narrow band or strip of material which extends circumferentially substantially around the entire periphery of the bag body 20 in the vicinity of the upper edge 28, and preferably spaced slightly downwardly therefrom. Alternatively, a support-engagement feature having a lesser circumferential extent may also be utilized, as represented by the embodiments of FIGS. 2 and 3. In the embodiment of FIG. 2, one or more circumferentially-extending strips of material oriented substantially parallel to the upper or peripheral edge 28 comprise support-engagement feature 3. As shown in FIG. 3, a plurality of similar strips of material oriented in a direction substantially normal to the upper edge 28 may comprise the support-engagement feature 30. Other variations such as plural parallel bands or strips in either circumferential, normal, or other directional orientations may be utilized as desired. A further embodiment of a flexible bag depicted in FIG. 4 is bag 10 which includes at least one, and preferably a plurality of, support-engagement features 30 in the form of flexible strips extending upwardly and/or outwardly from the upper edge 28 of the bag body 20. Such strips may be of any desired shape (e.g., lobes, tabs, etc.) and may be attached to or unitarily formed with the material of the bag body 20.

Various compositions suitable for constructing the flexible bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded from a starting blank or sheet of material rather than reliance upon folding and bonding techniques to construct the bag bodies from a web or sheet of material.

In accordance with the present invention, the support-engagement feature depicted in FIGS. 1–4 is constructed from a selectively activatible adhesive structure which provides a secure bond to complimentary surfaces upon activation.

As utilized herein, the term "selectively activatible" is used to refer to materials which exhibit substantially non-adherent properties when brought into contact with target surfaces until some action is taken by a user to "activate" the material to reveal adhesive properties. Accordingly, selectively-activatible properties differ from permanently-active strips of adhesive which rely upon removal of liner materials (typically silicone-coated paper strips) to expose the adhesive for use.

Selective activation of such materials allows the user to properly position opposing surfaces before activation and adhesion are accomplished, as well as minimizing the likelihood of contamination of the support-engagement feature by bag contents during filling operations. Preferably, the selective activation process is reversible such that the support-engagement feature may be de-activated and the bag removed from the supporting device and then re-activated for further engagement without significant loss of adhesive capability.

Although material utilized for the support-engagement feature may be provided with two active sides or surfaces, if desired for particular applications such as to provide a means to secure the feature to the bag or to provide a closure means for sealing the bag, in accordance with the present invention it is presently preferred to provide such material with only one active side and one inactive or inert side.

Various means of activation are envisioned as being within the scope of the present invention, such as: mechanical activation by compression, mechanical activation by tensile forces, and thermal activation. However, it is envisioned that there may be or be developed other means of activation which would trigger an adhesive or adhesive-like character which would be capable of functioning as herein described. In a preferred embodiment the active side is activatible by an externally applied force exerted upon the sheet of material. The force may be an externally applied compressive force exerted in a direction substantially normal to the sheet of material, an externally applied tensile force exerted in a direction substantially parallel to the sheet of material, or a combination thereof.

Regardless of the manner of activation, materials useful as a support-engagement feature in accordance with the present invention will exhibit an adhesive, adherent, or tacking character as opposed to merely a clinging or affinity character. As utilized herein, therefore, the term "adhesive" is utilized to refer to the ability of a material to exhibit an adherent character whether or not it actually includes a composition commonly understood and labelled as an adhesive. Accordingly, such materials will form a bond or seal when in contact with itself or another target surface as opposed to merely being attracted to such surface. While a number of approaches such as the use of selectively adherent materials may be utilized to provide the desired adhesive properties, a presently preferred approach is to utilize a pressure-sensitive adhesive.

When designing materials useful as a support-engagement feature in accordance with the present invention, it may be desirable to tailor the particular choice of adhesive agent so as to provide either a permanent bond or a releasable bond as desired for a particular application. Where a permanent bond is desired, removal of the flexible bag from the supporting device requires destruction of the bag. Releasable bonds, on the other hand, permit separation of the support-engagement feature from the supporting device at the bond site without destruction. Moreover, depending upon the activation mechanism employed in the design of the material, the releasable bond may additionally be refastenable if sufficient adhesive character remains after the initial activation/bonding/release cycle.

The support-engagement features useful in the present invention exhibit an adhesion sufficient to survive the likely degree of handling and external or internal forces the flexible bag is likely to encounter in use while maintaining the desired level of adhesive engagement with the opposing surface. At the same time, in a preferred embodiment the support-engagement feature is a substantially clingless material. Suitable methods of measuring and quantifying adhesive and cling properties are described in greater detail in commonly-assigned, co-pending U.S. Pat. No. 5,871,607, filed Nov. 8, 1996 in the names of Hamilton and McGuire, entitled "Material Having A Substance Protected by Deformable Standoffs and Method of Making", the disclosure of which is hereby incorporated herein by reference.

The support-engagement feature utilized in accordance with the present invention comprises a sheet of material having a first side and a second side. The first side comprises an active side exhibiting an adhesion peel force after activation by a user which is greater than an adhesion peel force exhibited prior to activation by a user. The active side of the support-engagement feature preferably exhibits an adhesion peel force of at least about 1 ounce per linear inch, more preferably between about 1 and about 2.5 ounces per linear inch, after activation by a user.

One such material of current interest for use as a support-engagement feature in accordance with the present invention comprises a three-dimensional, conformable web comprising an active substance such as adhesive on at least one surface protected from external contact by the three-dimensional surface topography of the base material. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. Representative adhesive carrier structures include those disclosed in commonly assigned, co-pending U.S. Pat. No. 5,662,758, filed Jan. 10, 1996 in the names of Hamilton and McGuire, entitled "Composite Material Releasably Sealable to a Target Surface When Pressed Thereagainst and Method of Making", U.S. Ser. No. 08/744,850, filed Nov. 8, 1996 in the names of Hamilton and McGuire entitled "Material Having A Substance Protected by Deformable Standoffs and Method of Making", U.S. Pat. No. 5,965,235, filed Nov. 8, 1996 in the names of McGuire, Tweddell, and Hamilton, entitled "Three-Dimensional, Nesting-Resistant Sheet Materials and Method and Apparatus for Making Same", U.S. Ser. No. 08/745,340, filed Nov. 8, 1996 in the names of Hamilton and McGuire, entitled "Improved Storage Wrap Materials". The disclosures of each of these applications are hereby incorporated herein by reference.

The three-dimensional structure comprises a piece of deformable material which has a first side formed to have a plurality of hollow protrusions separated by valleys. The plurality of hollow protrusions have outermost ends. The piece of material has a second side. The second side has a plurality of depressions therein corresponding to the plurality of hollow protrusions on the first side. The substance adheres to and partially fills the valleys between the plurality of hollow protrusions. The substance has a surface below the outermost ends of the plurality of hollow protrusions, so that when a portion of the first side of the piece of deformable film is placed against a target surface, the plurality of hollow protrusions prevent contact between the substance and the target surface until the portion is deformed at the target surface. Preferably, the plurality of protrusions deform by modes which are selected from the group consisting of inverting, crushing, and elongating. Preferably, in the inverting and/or crushing modes, each of the plurality of protrusions will not substantially deform until exposed to a pressure of at least 0.1 pounds per square inch (0.69 kPa).

FIGS. 5–9 illustrate a preferred embodiment of a material useful as a support-engagement feature for flexible bags according to the present invention, which comprises a three-dimensional sheet-like structure generally indicated as 30. Material 30 includes a deformed material 12 having hollow protrusions 14 and a layer of substance 16 located between protrusions 14. Protrusions 14 are preferably conical in shape with truncated or domed outermost ends 18. Protrusions 14 are preferably equally spaced in an equilateral triangular pattern, all extending from the same side of the material. Protrusions 14 are preferably spaced center to center a distance of approximately two protrusion base diameters or closer, in order to minimize the volume of valleys between protrusions and hence the amount of substance located between them. Preferably, the protrusions 14 have heights which are less than their diameters, so that when they deform, they deform by substantially inverting and/or crushing along an axis which is substantially perpendicular to a plane of the material. This protrusion shape and mode of deforming discourages protrusions 14 from folding over in a direction parallel to a plane of the material so that the protrusions cannot block substance between them from contact with a target surface.

Figure 7:
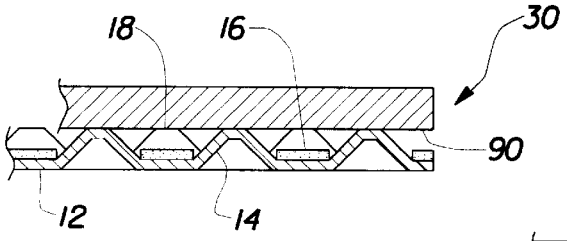
FIG. 7 is an elevational sectional view, taken along section line 7—7 of FIG. 6, showing the protrusions acting as standoffs for a substance layer between protrusions, such that a target surface contacting the outermost ends of the protrusions does not contact the substance layer.
Figure 8:
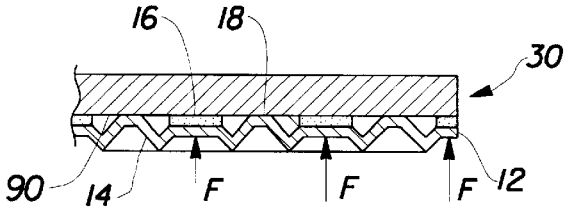
FIG. 8 is an elevational sectional view similar to FIG. 7, showing the effect of pressing the material against the target surface, such that protrusions deform by substantially inverting and/or crushing to allow the substance layer between protrusions to contact the target surface.

FIG. 7 shows a target surface 90, which is smooth but which may have any surface topography, being spaced away from layer of substance 16 by outermost ends 18 of protrusions 14. Target surfaces in accordance with the present invention will typically comprise an opposing portion of the supporting device. FIG. 8 shows target surface 90 contacting layer of substance 16 after protrusions 14 have been partially deformed under pressure applied to the non-substance side of material 12, as indicated by force F.

The more protrusions per unit area, the thinner the piece of material and protrusion walls can be in order to resist a given deformation force. Preferred layer of substance 16 is preferably a latex pressure sensitive adhesive or a hot melt adhesive, such as that available under specification no. Fuller HL-2115X, made by H. B. Fuller Co. of Vadnais Heights, Minn. Any adhesive can be used which suits the needs of the material application. Adhesives may be refastenable, releasable, permanent, or otherwise. The size and spacing of protrusions is preferably selected to provide a desired level of adhesion with a target surface while also providing the optimum pattern of standoffs for selective activation.

Film materials may be made from homogeneous resins or blends thereof Single or multiple layers within the film structure are contemplated, whether co-extruded, extrusion-coated, laminated or combined by other known means. The key attribute of the film material is that it be formable to produce protrusions and valleys. Useful resins include polyethylene, polypropylene, PET, PVC, PVDC, latex structures, nylon, etc. Polyolefins are generally preferred due to their lower cost and ease of forming. Other suitable materials include aluminum foil, coated (waxed, etc.) and uncoated paper, coated and uncoated nonwovens, scrims, meshes, wovens, nonwovens, and perforated or porous films, and combinations thereof.

Different applications for the support-engagement feature will dictate ideal size and density of protrusions, as well as the selection of the substances used therewith. It is believed that the protrusion size, shape and spacing, the web material properties such as flexural modulus, material stiffness, material thickness, hardness, deflection temperature as well as the forming process determine the strength of the protrusion. A "threshold" protrusion stiffness is required to prevent premature activation of the support-engagement feature due to the weight of overlaying layers of sheets or other forces, such as forces induced by shipping vibrations, mishandling, dropping and the like.

Inversion of protrusions minimizes protrusion spring back so that higher adhesion isn't necessary in order to prevent the failure of relatively weak seals. A resilient protrusion could be used, for example, where it is intended for the bond to be permanent, where aggressive adhesive overcomes spring back. Also, a resilient protrusion may be desirable where repeat use of the material is intended.

Figure 9:
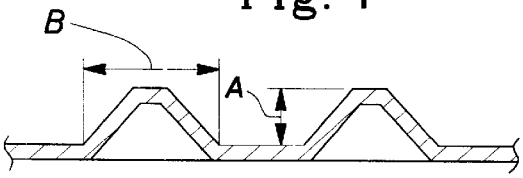
FIG. 9 is an elevational sectional view of the material of FIGS. 5–8, showing preferred dimensional relationships of protrusions.

FIG. 9 shows a preferred shape of the protrusions and valleys of support-engagement features of the present invention, which enables protrusions to substantially invert and/or crush as a mode of deforming. The preferred shape minimizes protrusion fold-over and interference with substance placed in valleys between protrusions, or inside hollow protrusions, or both. Also, the preferred shape helps to ensure a repeatable, predictable, resistance to protrusion deformation. FIG. 9 shows that each protrusion is defined by a height dimension A and a base diameter dimension B. A preferred ratio of base diameter B to height A, which enables protrusions to substantially invert and/or crush without fold-over, is at least 2:1.

Figure 10:
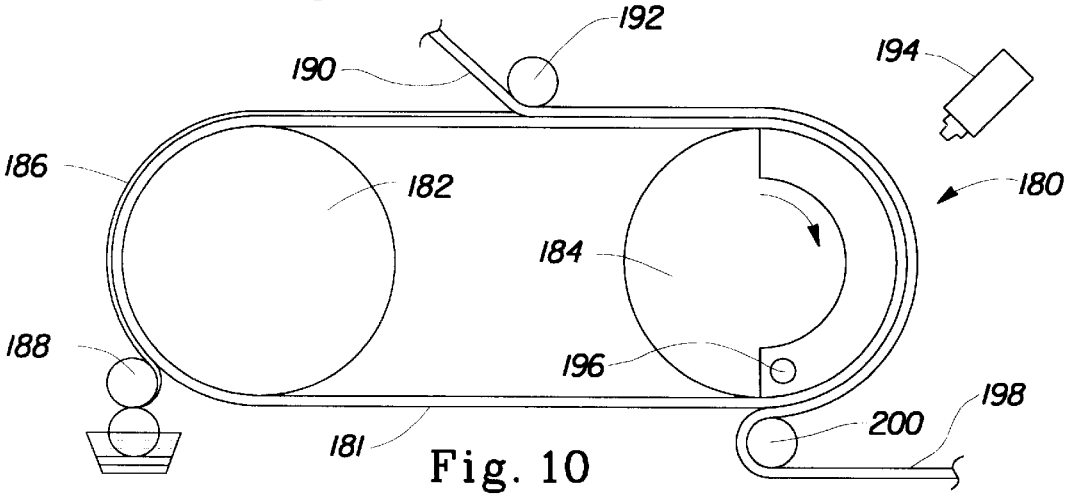
FIG. 10 is a schematic view of a suitable method of making a material suitable for use as a support-engagement feature of the present invention, showing a forming screen as a belt wrapped around a vacuum drum and a drive pulley.

FIG. 10 shows a suitable method for making a material such as the support-engagement feature 30 useful in accordance with the present invention, which is generally indicated as 180 in FIG. 10.

The first step comprises coating a forming screen with a first substance. The forming screen has a top surface and a plurality of recesses therein. The coating step applies the first substance to the top surface without bridging the recesses. A second step includes introducing a piece of material, which has a first side and a second side, onto the forming screen such that the first side is in contact with the first substance on the top surface of the forming screen. The first substance preferentially adheres to the first side of the piece of material. A third step includes forming the piece of material to create a plurality of hollow protrusions extending from the first side into the recesses of the forming screen. The plurality of hollow protrusions are spaced apart by valleys into which the first substance is transferred from the forming screen. The plurality of hollow protrusions are accurately registered with the first substance by use of a common transfer and forming surface. The first substance forms an interconnected layer in the valleys between the protrusions.

Forming screen 181 is threaded over idler pulley 182 and a driven vacuum roll 184. Forming screen 181 is preferably a stainless steel belt, having the desired protrusion pattern etched as recesses in the belt. Covering the outer surface of vacuum roll 184 is a seamless nickel screen which serves as a porous backing surface for forming screen 181.

For producing a pressure sensitive adhesive containing material, a substance 186, preferably hot melt adhesive, is coated onto forming screen 181 by a substance applicator 188 while forming screen 181 rotates past the applicator. A web of material 190 is brought into contact with the substance coated forming screen at material infeed idler roll 192. Hot air is directed radially at material 190 by a hot air source 194 as the material passes over vacuum roll 184 and as vacuum is applied to forming screen 181 through vacuum roll 184 via fixed vacuum manifold 196 from a vacuum source (not shown). A vacuum is applied as the material is heated by hot air source 194. A formed, substance coated material 198 is stripped from forming screen 181 at stripping roll 200. Because the same common forming screen is used to transfer the substance to the material as is used to form the protrusions, the substance pattern is conveniently registered with the protrusions.

Stainless steel forming screen 181 is a fabricated, seamed belt. It is fabricated in several steps. The recess pattern is developed by computer program and printed onto a transparency to provide a photomask for photoetching. The photomask is used to create etched and non-etched areas. The etched material is typically stainless steel, but it may also be brass, aluminum, copper, magnesium, and other materials including alloys. Additionally, the recess pattern may be etched into photosensitive polymers instead of metals. Suitable forming structures are described in greater detail in the above-referenced and above-incorporated Hamilton et al. and McGuire et al. patent applications.

Materials of the foregoing variety when utilized as a support-engagement feature in accordance with the present invention may be unitarily formed and constructed as part of the body of the flexible bag either before, during, or after assemblage of the bag from its material components. Alternatively, such support-engagement features may also be separately formed and joined to the body of the flexible bag either before, during or after assemblage of the bag. Such joining may be edge-wise or may be accomplished as a lamination or bonding of the material facially onto a superposed portion of the bag body, such lamination being particularly advantageous when it is desired to add additional thickness, stiffness, and/or resiliency to the region of the bag comprising the support-engagement feature. The material utilized for the support-engagement feature may be the same as or different from the material utilized to form the bag body either in dimensions or in composition.

Figure 11:
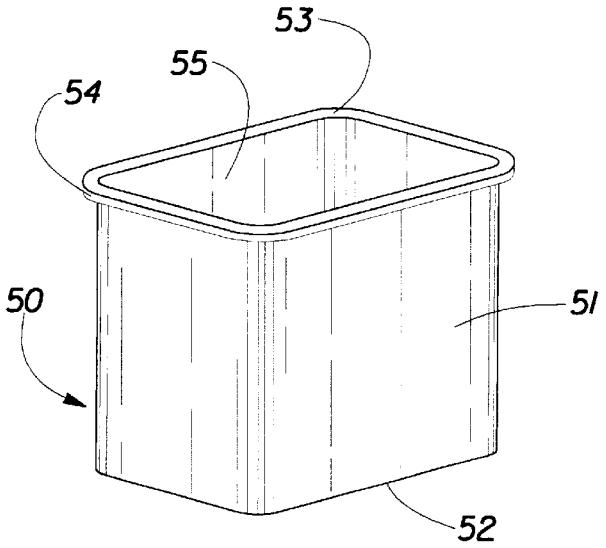
FIG. 11 is a perspective view of a representative reusable, durable container suitable for use as a supporting device in conjunction with a flexible bag according to the present invention.
Figure 12:
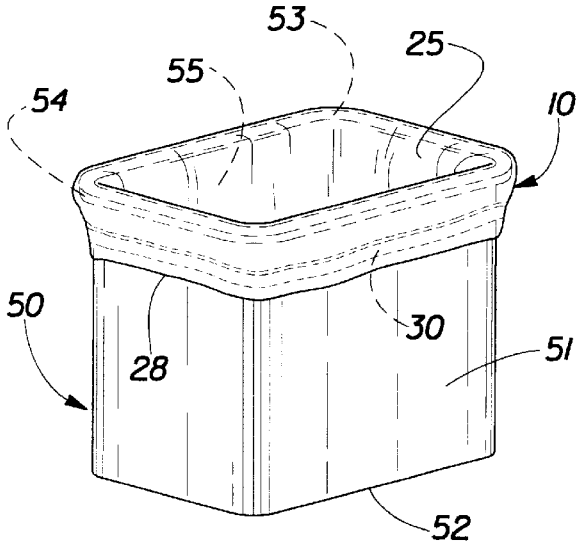
FIG. 12 is a perspective view of the reusable, durable container of FIG. 10 with a flexible bag according to the present invention placed therein as a removable replaceable liner.
Figure 13:
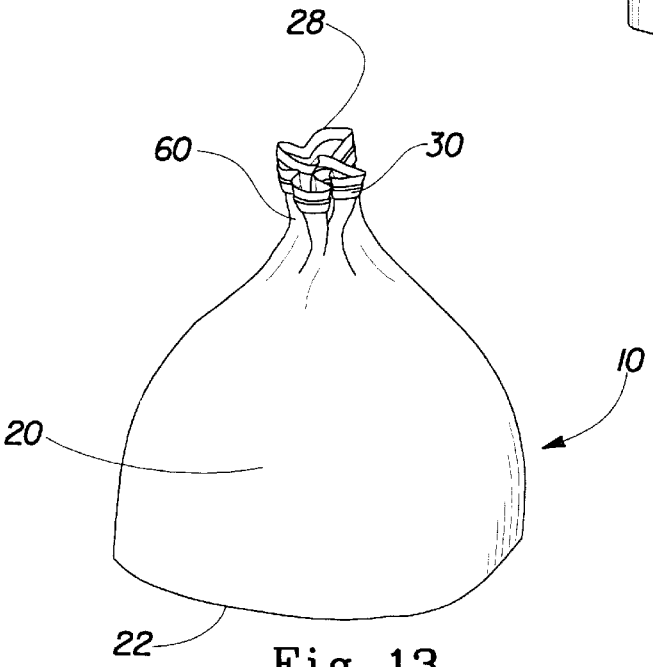
FIG. 13 is a perspective view of a flexible bag of the present invention in a filled and securely closed condition.

FIGS. 11–13 depict a typical scenario illustrating the advantages of the flexible bags of the present invention.

FIG. 11 depicts a typical reusable, durable container 50 suitable for use as a supporting device in conduction with the flexible bags 10 of the present invention. The container 50 includes a container body 51 (which may be formed as a cylinder of circular, elliptical, square, rectangular, or other desirable cross-section, and may have straight or tapered sides), a bottom 52, an upper edge 53, a flange 54, and an interior 55. Container 50 may be of any desired material construction, such as wood, metal, plastic, etc.

FIG. 12 depicts a flexible bag of the configuration depicted in FIG. 1 installed as a removable, replaceable liner in the reusable, durable container 50. Accordingly, the flexible bag is inserted into the interior 55 of the container 50 such that the open edge of the bag 28 is located substantially adjacent to the upper edge 53 of the container. As is common practice, it is preferable to extend the upper edge of the bag laterally outwardly beyond the upper edge 53 of the container and then downwardly over the upper portion of the exterior of the container body, such that the upper edge is protected by the bag body. The support-engagement feature 30 is on the outside of the bag as depicted in FIG. 1 so that it may be activated to adhere the upper portion of the flexible bag to the surface of the container to hold the mouth of the bag in fixed relation to the upper edge of the container. Activation of the support-engagement feature may be obtained by simply pinching or compressing the support-engagement feature against the desired target surface, typically an external surface of the container, to activate the adhesive properties described herein. In another approach, the support-engagement feature may be secured to the inner surface of the upper edge of the container, or may even be secured to the upper edge, or to the flange 54 of the container, as desired. Where the supporting device comprises simply a hoop or projecting arms, the support-engagement feature may be activated to adhere to such structures or may be activated to adhere the feature to another portion of the flexible bag to form a collar of bag material to capture the hoop or projecting arms therein. Utilization of a support-engagement feature according to the present invention therefore securely retains the mouth of the flexible bag in the desired open condition and in the desired orientation relative to a supporting device.

Another advantage with this approach is that air and/or free space may be released from between the exterior surface of the flexible bag and the interior surface of the supporting device when the initially empty flexible bag is inserted into a larger, typically largely-enclosed rigid or semi-rigid durable container and frictionally or tightly engaged with the rim of the container by folding or stretching the bag material. With conventional means of retaining a flexible bag, such a situation frequently limits the ability to fully utilize the full volume potential of the flexible bag as the trapped air prevents the bag from expanding to approach the interior volume of the durable container. In accordance with the present invention, the bag may more loosely fit the mouth of the container rather than being tightly frictionally engaged therewith. Where the support-engagement feature fully encircles the periphery of the mouth of the bag, any activation short of complete activation (such as by only compressing a few selected peripheral locations) will allow one or more passages for trapped air to escape as the addition of contents to the interior of the bag expands the bag volume to approach that of the supporting device/container. Support-engagement features such as those of FIGS. 2–4, which are disposed only at intermittent circumferential locations, will automatically provide this desirable benefit.

While the container 50 has been utilized to represent what may be the most common use scenario anticipated, it is recognized that there may be a wide variety of supporting devices which may be utilized in conjunction with the flexible bags of the present invention. For example, the supporting device may comprise a hoop of material suitable for supporting the mouth of the flexible bag, rather than a conventional three-dimensional semi-enclosed durable container. Alternatively, the supporting device may comprise one or more arm-like structures (which may comprise portions or segments of a hoop) likewise suitable for holding the mouth of the bag in an open condition. The support-engagement feature of the present invention may also be utilized in conjunction with a wall, countertop, or other surface or structure to hold the mouth of the bag in an open or at least semi-open condition for use.

When it is desired to remove the flexible bag from the supporting device and effect closure, all that is required is to simply peel the support-engagement feature from its target surface and lift the bag free. Closure of the opening of the bag may be achieved by simply gathering the upper edge 28 as shown in FIG. 13 (region 60), which causes the support-engagement feature to engage superimposed portions of the bag body to secure the bag in a closed configuration with the open edge 28 of the bag being appropriately constricted. Alternatively, other more conventional means of closure such as separate ties or clips may be employed, as well as other means of tying the bag material itself into a knot.

Materials of the foregoing description may also be employed on inner surfaces of the flexible bag to provide an interior closure means 40 (as shown in FIG. 1). Accordingly, the above described material will provide adhesion of inner surfaces of the bag body adjacent to the upper edge 28 to provide a secure seal. The use of such materials as closures in flexible bags is described in greater detail in commonly-assigned, concurrently-filed, copending U.S. patent application Ser. No. 08/853,003, Attorney's Docket No. Case 6618, filed May 9, 1997 in the names of Hamilton et al., the disclosure of which is hereby incorporated herein by reference.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible bag comprising at least one sheet of flexible sheet material assembled to form a semi-enclosed container having an interior surface, an exterior surface, an opening having a peripheral edge, and a support-engagement feature located on said exterior surface, wherein said support-engagement feature comprises a piece of material having a first side facing outwardly from said exterior surface and a second side facing inwardly toward said interior surface, said first side exhibiting an adhesion peel force after activation by a user which is greater than an adhesion peel force exhibited prior to activation by a user, said first side being selectively activatible by a user without requiring removal of a liner material and being adherable to a wide variety of supporting devices.

2. The flexible bag of claim 1, wherein said bag includes a closure means for sealing said opening to convert said semi-enclosed container to a closed container, said opening having a periphery, wherein said closure means comprises a piece of material forming at least a portion of said periphery, said piece of material having a first side facing inwardly toward said opening and a second side facing outwardly of said opening, said first side exhibiting an adhesion peel force after activation by a user which is greater than an adhesion peel force exhibited prior to activation by a user.

3. The flexible bag of claim 1, wherein said support-engagement feature fully surrounds said peripheral edge.

4. The flexible bag of claim 1, wherein said support-engagement feature partially surrounds said peripheral edge.

5. The flexible bag of claim 4, wherein said support-engagement feature comprises a plurality of strips oriented in a direction substantially normal to said peripheral edge.

6. The flexible bag of claim 4, wherein said support-engagement feature comprises a plurality of strips of material oriented in a direction substantially parallel to said peripheral edge.

7. The flexible bag of claim 1, wherein said support-engagement feature extends upwardly or outwardly from said peripheral edge.

8. The flexible bag of claim 1, wherein said support-engagement feature is activatible by an externally applied force exerted upon said piece of material.

9. The flexible bag of claim 8, wherein said support-engagement feature is activatible by an externally applied compressive force.

10. The flexible bag of claim 8, wherein said support-engagement feature is activatible by an externally applied tensile force.

11. The flexible bag of claim 1, wherein said support-engagement feature is clingless and exhibits no adhesion peel force prior to activation by a user.

12. The flexible bag of claim 1, wherein said support-engagement feature is unitarily formed from said sheet material.

13. The flexible bag of claim 1, wherein said support-engagement feature comprises a separate material element joined to said sheet material.

14. The flexible bag of claim 1, wherein said support-engagement feature comprises a three-dimensional sheet material which is convertible to a substantially two-dimensional sheet material upon activation by a user to expose an adhesive layer to contact with a complementary surface of a supporting structure.

15. The flexible bag of claim 1, wherein said sheet material comprises a polymeric film material.

16. The flexible bag of claim 1, wherein said support-engagement feature comprises a closure means.

17. The flexible bag of claim 1, wherein said support-engagement feature includes a pressure-sensitive adhesive.

18. A flexible bag comprising at least one sheet of flexible sheet material assembled to form a semi-enclosed container having an interior surface, an exterior surface, an opening having a peripheral edge, and a support-engagement feature located on said exterior surface, wherein said support-engagement feature comprises a piece of material having a first side facing outwardly from said exterior surface and a second side facing inwardly toward said interior surface and at least partially circumferentially surrounding said peripheral edge, said first side exhibiting an adhesion peel force after activation by a user which is greater than an adhesion peel force exhibited prior to activation by a user, wherein said support-engagement feature is activatible by an externally applied compressive force exerted upon said piece of material, said first side being selectively activatible by a user without requiring removal of a liner material and being adherable to a wide variety of supporting devices.

19. A flexible bag comprising at least one sheet of flexible sheet material assembled to form a semi-enclosed container having an interior surface, an exterior surface, an opening having a peripheral edge, and a support-engagement feature located on said exterior surface, wherein said support-engagement feature comprises a piece of material having a first side facing outwardly from said exterior surface and a second side facing inwardly toward said interior surface and at least partially circumferentially surrounding said peripheral edge, said first side exhibiting an adhesion peel force after activation by a user which is greater than an adhesion peel force exhibited prior to activation by a user, wherein said support-engagement feature is activatible by an externally applied compressive force exerted upon said piece of material, wherein said support-engagement feature comprises a closure means said first side being selectively activatible by a user without requiring removal of a liner material and being adherable to a wide variety of supporting devices.

* * * * *